US005492576A

United States Patent [19]

Jehl et al.

[11] Patent Number: 5,492,576

[45] Date of Patent: Feb. 20, 1996

[54] METHOD OF MAKING A DIAPHRAGM, ESPECIALLY FOR A MOTOR VEHICLE CLUTCH

[75] Inventors: Patrick Jehl, Amiens; Jean-Pierre Vrinat, Osny, both of France

[73] Assignee: Valeo, Paris, France

[21] Appl. No.: 812,036

[22] Filed: Dec. 23, 1991

[30] Foreign Application Priority Data

Dec. 26, 1990 [FR] France ..... 90 16259

[51] Int. Cl.[6] ..... C21D 9/02; F16D 13/00

[52] U.S. Cl. ..... 148/580; 148/648; 148/649; 148/653; 192/89.22

[58] Field of Search ..... 148/580, 648, 148/649, 653; 192/89 B, 89.22; 266/105

[56] References Cited

U.S. PATENT DOCUMENTS

| | | | |
|---|---|---|---|
| 3,213,991 | 10/1965 | Smirl et al. | 192/89 B |
| 3,668,917 | 6/1972 | Komatsu et al. | 148/580 |
| 3,753,798 | 8/1973 | Komatsu et al. | 148/580 |
| 3,977,504 | 8/1976 | Kajitani | 192/89 B |
| 4,132,103 | 1/1979 | Le Brise | 72/326 |
| 5,044,611 | 9/1991 | Beney et al. | 266/105 |

FOREIGN PATENT DOCUMENTS

| | | |
|---|---|---|
| 0341146 | 11/1989 | European Pat. Off. . |
| 1598224 | of 1970 | France . |
| 2142158 | 1/1973 | France . |
| 2286976 | 4/1976 | France . |
| 2361170 | 3/1978 | France . |
| 999070 | 7/1965 | United Kingdom . |
| 1402144 | 8/1975 | United Kingdom . |
| 1514297 | 6/1978 | United Kingdom . |

*Primary Examiner*—Sikyin Ip
*Attorney, Agent, or Firm*—Longacre & White

[57] ABSTRACT

A clutch diaphragm comprises a peripheral Belleville ring portion and a central portion having a central aperture and comprising a set of radial fingers separated by slots, each of which extends from a blind end which is close to the peripheral portion to an inner end which is open into the central aperture, the latter being common to all of the slots.

In a method of making this diaphragm, a flat blank is heat treated and is then soaked and hot formed to give the diaphragm a first diaphragm angle. It is then tempered in a tempering oven. The diaphragm is then transferred from the tempering oven to a stabilizing press, in which the conicity of the diaphragm is reversed while it is still hot from the tempering oven, so that instead of the first angle it now has an inversion angle.

6 Claims, 2 Drawing Sheets

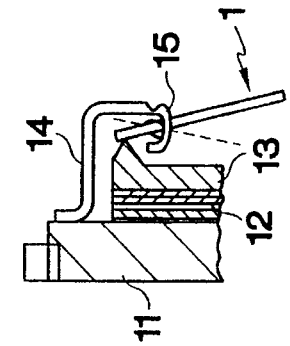
FIG. 2
(PRIOR ART)
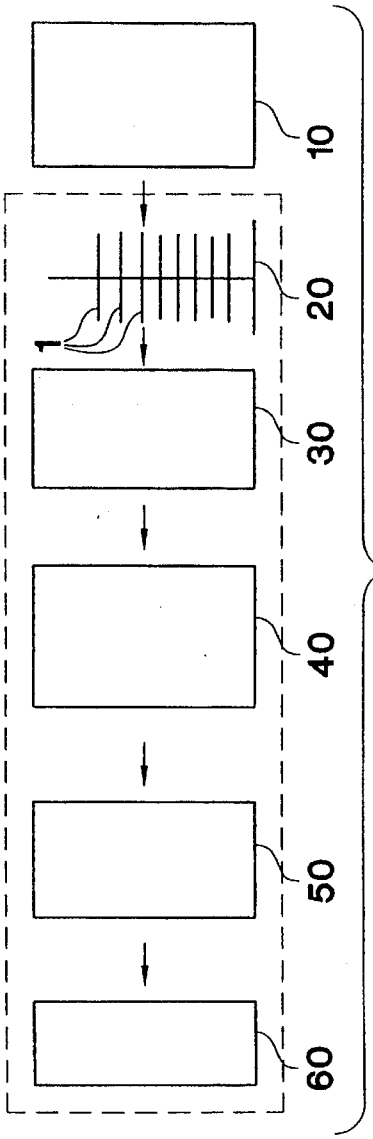
FIG. 1A
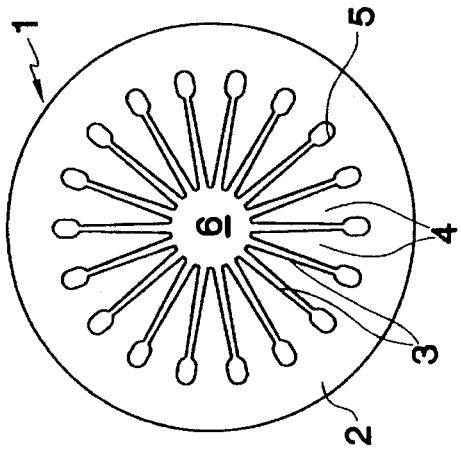
FIG. 1B
FIG. 1C
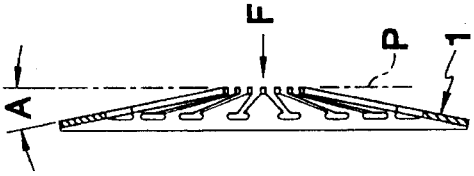
FIG. 1D
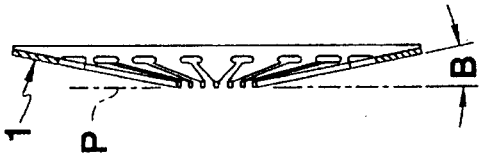
FIG. 1E
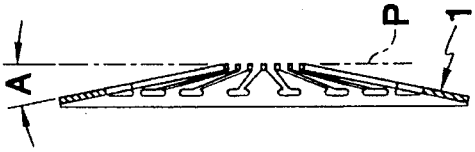
FIG. 1F

METHOD OF MAKING A DIAPHRAGM, ESPECIALLY FOR A MOTOR VEHICLE CLUTCH

FIELD OF THE INVENTION

The present invention relates to a method of making a diaphragm, in particular for motor vehicle clutches, of the kind having a peripheral portion defining a Belleville ring together with a central portion divided into radial fingers which are separated by slots, each of which extends from a blind end, which is close to the said peripheral portion, to an open end through which the slot is open into a central aperture common to all the slots, wherein a blank is first subjected to a heat treatment operation, followed by an operation of soaking and hot forming to confer a first angle on the diaphragm, and then a tempering operation in a tempering oven. Such a method will be called a method of the kind specified.

BACKGROUND OF THE INVENTION

A diaphragm of the kind described above is disclosed in, for example, the specifications of United Kingdom published patent application No. GB1 402 144A and U.S. Pat. No. 4,132,103. As is well known, the clutch diaphragm constitutes an axially acting resilient means exerting a force on, for example, a pressure plate of the clutch for gripping a friction disc or clutch friction plate. It is desirable that this force exerted by the diaphragm should remain constant with time. One of the major parameters which governs this is the temperature which the diaphragm may reach in service. For example, in the case of a friction clutch, the temperature of the diaphragm may reach high temperatures, in particular during uphill starting, when the friction liners may become very hot. This heat can be transmitted to the diaphragm, which may thus be subjected to temperatures of the order of 200° C. It is important that the diaphragm should not slacken even during operation at these high temperatures.

DISCUSSION OF THE INVENTION

An object of the present invention is to provide a new diaphragm which is stable over time while being able to undergo high temperature operation.

According to the invention, a method of the kind specified is characterised in that the diaphragm is transferred from the tempering oven to a stabilizing press, and in the stabilizing press, the angle of the diaphragm is reversed while the diaphragm is still hot on leaving the tempering oven, so as to change the first angle to an inversion angle.

The diaphragm made in this way does not slacken, or relax under load, even at high temperatures, so that the resilient force which it exerts remains substantially constant.

A preferred embodiment of the invention will be described below, by way of example only and with reference to the accompanying drawings.

BRIEF DESCRIPTION OF THE DRAWINGS

FIG. 1 is a flow diagram showing the method of manufacture.

FIG. 2 is a simplified scrap cross sectional view showing part of a conventional clutch.

DESCRIPTION OF A PREFERRED EMBODIMENT OF THE INVENTION

Figure 3:
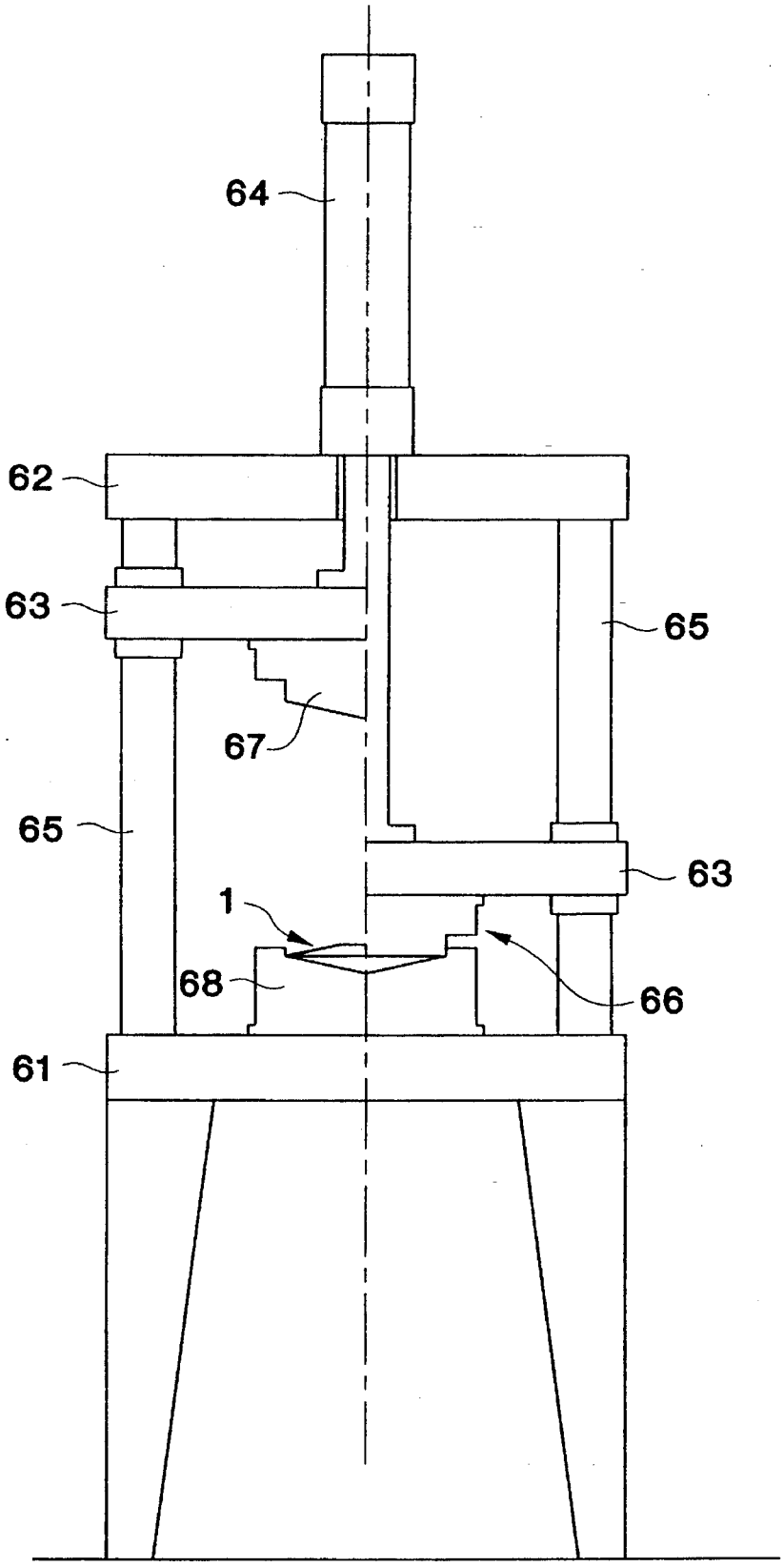
FIG. 3 is a somewhat diagrammatic elevation of the stabilising press.

As is shown in FIG. 1, the resilient component to be manufactured is a diaphragm 1 of frusto-conical form, of the kind comprising a peripheral portion 2 in the form of a Belleville ring, together with an integral central portion which is divided into a plurality of radial fingers 4 separated by slots 3. Each of the slots 3 terminates at its outer end in a widened orifice 5 which defines a blind end close to the inner periphery of the Belleville ring portion 2. At its inner end, each slot 3 terminates in a common central aperture 6. Thus each slot 3 extends radially from a blind end 5 close to the ring portion 2, to an inner end which is open into the aperture, or central space, 6.

In the known manner illustrated in FIG. 2, and as is also disclosed in, for example, the specification of published French patent application No. FR 2 286 976A and the corresponding U.S. Pat. No. 3,977,504, such a diaphragm 1 is adapted particularly for inclusion in clutch mechanisms for motor vehicles. Such a clutch includes a cover plate 14 which is secured to a reaction plate 11 fixed to the crankshaft of the internal combustion engine of a motor vehicle. The clutch also includes at least one pressure plate 13 which is fixed in rotation to the cover plate 14, and which is mounted for limited axial movement with respect to the latter; and a diaphragm 1 which bears on the cover plate 14 for action on the pressure plate 13.

Conventionally, the rotational coupling of the pressure plate to the cover plate is obtained by means of tangential tongues, which are fixed at one of their ends to a lug of the pressure plate, being fixed at their other ends to a securing lug of the cover plate. In a modification, a coupling of the tenon and mortice type may be used.

The clutch mechanism forms a unitary assembly, which is adapted to be mounted on the reaction plate 11 of the clutch by means of its cover plate. The pressure plate is biassed towards the reaction plate by the diaphragm, so that friction liners 12, coupled to a hub, can be gripped between the pressure plate 13 and the reaction plate 11. The coupling between the friction liners and the hub is generally obtained by means of a torsion damping device, with the hub being fixed in rotation to the input shaft of the gearbox. The diaphragm thus constitutes an axially acting resilient means, and its shape is normally frusto-conical.

In FIG. 2, the diaphragm 1 is mounted so as to deform in such a way that elements of the diaphragm undergo a tilting movement on the cover plate 14, by virtue of assembly means 15 in the form of lugs projecting from the cover plate and passing through the apertures 5 in the diaphragm. These lugs have a free end which is bent radially away from the axis of the assembly, and they act as engagement elements for a ring defining a secondary tilting fulcrum for the diaphragm 1, arranged facing a primary fulcrum constituted by a pressed-out element of the cover plate 14.

The clutch, and therefore the clutch mechanism, is normally in the position or configuration in which the clutch is engaged, such that the diaphragm then has a shape which is substantially flat when the friction liners are new. In order to disengage the clutch, it is necessary to apply a clutch release bearing on the ends of the fingers 4, so as to cause the latter to tilt (as indicated by broken lines in FIG. 2) as the diaphragm deforms in such a way that its concavity is reversed. At the end of this movement of the diaphragm, the clutch with its clutch mechanism occupies a final position or configuration in which the clutch is disengaged, more usually called the declutched position.

The force exerted by the diaphragm 1 on the pressure plate 13 then depends on its thickness and on its diaphragm angle, i.e. the angle of inclination A with respect to the vertical plane P. This angle, as can be seen from FIG. 1, is complementary to one-half of the cone angle defined by the frusto-conical diaphragm.

It is therefore important to stabilize the diaphragm, especially in relation to temperature. To this end, the diaphragm is transferred from a tempering oven 50 to a stabilizing press 60, in which the angle of the diaphragm, which is still hot from the tempering oven 50, is reversed by reversing the conicity of the diaphragm. More precisely, the diaphragm blank, which is formed in a blanking press 10, is transferred into a machine, indicated by broken lines in FIG. 1, which continuously and automatically soaks and shapes the blank, tempers it and carries out the operation of stabilizing the diaphragm, so as to confer on the latter the required properties of elasticity and/or hardness.

Referring in particular to FIG. 1, it can be seen from this that the diaphragm 1 is flat on exit from the blanking press 10. At the end of this first operation it includes the Belleville ring portion 2, the fingers 4, the slots 3, apertures 5 and central aperture 6. For more detail about the manufacture of the diaphragm blank, reference is invited for example to the specification of U.S. Pat. No. 4,132,103. The operation is carried out using punches, in pressing out and cutting operations, the punches being mounted for movement between stop surfaces in association with dies which grip the sheet metal workpiece. Ejectors, mounted for movement between the dies, are associated with the punches.

The flat blank is then transferred to the machine. The latter includes a loading station 20, an austeniting oven 30, a hot forming press 40, the tempering oven 50 and the stabilizing press 60, in that order. The hot forming press 40 is equipped with a water cooled forming tool, and the tempering oven 50 is of the continuous chain or curtain type. The stabilizing press 60 is equipped with a water cooled inversion or stabilizing tool. Suitable transfer systems are provided for transferring the workpiece into the tempering oven 50 and into the stabilizing press 60. Finally, the machine has a suitable means for removing the workpiece from the stabilizing press.

The loading station 20 comprises a small magazine which is able to receive stacks of diaphragm blanks on pallets from the press shop and the blanking press 10. An elevator maintains the blanks at constant level, in such a way that a suitable handling device, having a head fitted with permanent magnets, can pick them up and transfer them one by one on to transfer racks for transfer into the austeniting oven 30.

The austeniting oven 30 consists of a welded metal carcase lined internally with a thermal insulator, for example in the form of a fibrous insulating material. The oven 30 is brought to a temperature of (for example) 860° C. by means of radiant U-shaped tubes, heated by means of natural gas. Regulation of the temperature is obtained using a pyrometric chain which includes a pyrometric probe, together with a compensating cable and a regulator which operates a control valve for the gas supply. In a modification, the oven may be electrically heated by means of electrical heating plates or resistive heaters. The austeniting of the diaphragms is carried out in a neutral atmosphere by injection of ammonia and methanol into the oven. Preferably, the methanol is injected into the oven in its gaseous phase.

Inside the oven 30, the workpieces which have been introduced by the racks at the loading station 20 are received and held on a slotted wheel. Each time a workpiece is introduced into the wheel, the latter rotates through the pitch of one slot. After one half-rotation of the wheel, the workpiece is deposited once again on the transfer racks so as to be removed to the hot forming press 40.

The hot forming press 40 and the stabilizing press 60 each comprise two fixed tables, namely a lower table and an upper table, together with a movable table which is actuated by means of a hydraulic jack and guided by columns having sliding ball bearings. A flanged forming tool is mounted by means of hydraulic jacks on the lower fixed table and on the movable table. In a modification, presses in which the tool is changed by cassette may be used. In the present example, the forming tool consists of a movable punch and a fixed forming die, and it is cooled by means of an internal water circuit.

Introduction of the workpiece into the tool, and its removal from it, is carried out with the aid of a suitable extractor which is actuated by a pneumatic jack working in the axis of the tool. For more detail about this, reference is invited to, for example, the specification of published French patent application No. FR 1 598 224A and that of published European patent application No. EP 0 341 146A.

After the hot forming operation, the diaphragm is frusto-conical in its free state, defining a first diaphragm angle A with respect to the vertical plane P. This angle has been imposed by the hot forming tool in the press 40.

On leaving the press 40, the diaphragms are transferred to the tempering oven 50, by means of apparatus which takes the workpiece from the extractor of the hot forming press and places it in the chain or on the curtain of the tempering oven 50. The latter is in the form of a metal carcase which is internally lined with, for example, a fibrous material to give the necessary thermal insulation. As in the austeniting oven 30, the workpieces are heated in the tempering oven 50 by means of radiant electrical heating plates or electrical resistance heaters, with an air blower operating to mix the air so as to ensure an even temperature within the oven 50. In this example, tempering takes place at a temperature of about 390° C., the time of passage through the oven 50 being about 30 minutes.

As in the austeniting oven 30, a temperature regulating device is provided together with a pyrometric chain including a pyrometric probe, a compensating cable and a regulator controlling a power transistor for controlling the electric plates. Within the oven 50, there is a chain mounted on toothed wheels for receiving and holding the workpieces delivered by the transfer mechanism that transfers them from the hot forming press 40 to the tempering oven 50. The length of this chain is calculated in accordance with the required passage time through the oven 50. A gate of the guillotine type is of course provided to limit the ingress of cold air into the oven 50 from outside during transfer of the workpieces into and out of the oven.

On leaving the tempering oven 50, the workpieces are transferred into the stabilizing press 60 by means of a device which picks them up from the tempering oven 50 and places them on the extractor of the stabilizing tool which is part of the press 60.

As mentioned above, the stabilizing press 60, which is shown in FIG. 3, is similar to the hot forming press 40 and comprises two fixed tables 61 and 62 and a movable table 62. A stabilizing tool 66 is mounted on the lower fixed table 61 and the movable table 63. The stabilizing tool 66 is carried by hydraulic jacks. The said tool comprises a ram 67 and a forming die 68, and is water cooled. The workpiece is introduced to the tool and removed from it by means of an extractor which is moved by means of a pneumatic jack working along the axis of the tool.

It will be noted that this stabilizing tool reverses the first angle A of the diaphragm which has left the tempering oven 50 at a temperature of 390° C., and cools it by means of its internal water cooling circuit. In practice, the angle of inversion B (see FIG. 1), to which the angle A is converted, is between 5 and 15 degrees. This angle B may be of a similar value to the first angle A of the diaphragm. For example if the angle A is 11°, the inversion angle B is −10°. Experience has shown that very good results are obtained by reversing the diaphragm into the form which is identical (and which thus has an identical conicity) to that which it will have when mounted in the declutched position in the clutch.

Downstream of the stabilizing press 60, a discharge mechanism is provided, which comprises for example two small magazines which are adapted to receive empty pallets, on which a manipulator places the workpieces which it has picked up from the stabilizing tool.

As will have been understood from the foregoing, passage of the workpiece through the machine enables the diaphragm to be given a frusto-conical form, together with the required hardness and/or elasticity, with acceptable internal stresses.

The present invention is of course not limited to the embodiment described above. In particular, whereas in the above example the inversion angle B was smaller in numerical value than the first angle A of the diaphragm, in a modification the angle B may have a numerical value which is greater than the angle A.

It is also possible to carry out, in the manner described in the specification of United Kingdom published patent application No. GB 1 402 144A, a heat treatment for cementation and carburization. It is also possible to carry out shot blasting after the workpiece has passed through the tempering oven 50, on one or both faces of the diaphragm 1, in the manner described in the specification of French published patent application No. FR 2 286 976A and the corresponding U.S. Pat. No. 3,977,504.

Finally, the diaphragm 1 may be equipped with speed-varying means, of the kind comprising an endless belt mounted between a driving pulley and a driven pulley, with at least one of these pulleys comprising a movable wheel and a fixed wheel, the movable wheel being arranged to be displaced under the action of a diaphragm bearing on the latter and on an abutment member which is fixed to a hub which is itself fixed to the fixed wheel of the pulley. In such a case, the variable pulley of the speed-varying means has two extreme configurations, namely (a) an initial extreme configuration corresponding to a low rotational velocity of the variable pulley, and (b) an operating extreme configuration corresponding to higher rotational velocities of the variable pulley. The angle of the diaphragm is then inverted in the stabilizing process in such a way as to give it a shape (conicity) which is identical to that which it has in its operating extreme terminal configuration.

What is claimed is:

1. A method of making a motor vehicle clutch diaphragm which in its relaxed state is generally frusto-conical defining a diaphragm angle complementary to its cone half angle, the diaphragm comprising a peripheral portion defining a Belleville ring and a central portion joined to the peripheral portion and having a central aperture, with a plurality of slots extending from an open end proximate said central aperture to a blind end proximate said peripheral portion so as to define a plurality of radial fingers between the slots, wherein the method includes the steps of:

heat treating a metal blank;

soaking and hot forming said heat treated metal blank so as to define a partly formed diaphragm having a first diaphragm angle, said first diaphragm angle being of a frusto-conical shape;

tempering said partly formed diaphragm in a tempering oven;

transferring said partly formed diaphragm from said tempering oven to a stabilizing press;

reversing the frusto conical shape of said partly formed diaphragm while still hot from said tempering oven, wherein said first diaphragm angle is converted to a second diaphragm angle, said second diaphragm angle being an inversion angle with respect to said first diaphragm angle.

2. A method according to claim 1, wherein the step of reversing the frustoconical shape is carried out by means of a stabilizing tool mounted on the stabilizing press, and the method further includes the step of simultaneously cooling the diaphragm by means of a water cooling circuit incorporated in the stabilizing tool.

3. A method according to claim 2, wherein the stabilizing press comprises at least one fixed table, including a lower fixed table, and a movable table, the stabilizing tool being mounted on the lower fixed table and on the movable table.

4. A method according to claim 3, wherein the stabilizing tool comprises a ram and a forming die cooperating with the ram.

5. A method according to claim 1, wherein said inversion angle in the inclusive range 5 to 15 degrees.

6. A method according to claim 1, for making said diaphragm for a clutch mechanism comprising a cover plate and a pressure plate, with the diaphragm mounted in engagement on the cover plate so as to act on the pressure plate, for deformation of the diaphragm between a clutch engaged position and a clutch disengaged position, and wherein the step of reversing the conicity of the diaphragm in the stabilizing press comprises giving it a shape substantially identical to that which it is to have in the condition of the said clutch mechanism in which the clutch is disengaged.

* * * * *